US005864989A

United States Patent [19]

Funatsu et al.

[11] Patent Number: 5,864,989

[45] Date of Patent: Feb. 2, 1999

[54] VENTILATING WINDOW

[75] Inventors: Masayoshi Funatsu; Murao Iwatsuki; Atsushi Suzuki; Tatsuo Shiobara; Hideo Hochi, all of Tokyo; Kazuo Iwaki, Takaoka; Osamu Arayama, Takaoka; Masanori Hirata, Takaoka; Yoshikazu Nomura, Takaoka; Kunihiko Ebitani, Takaoka; Atsushi Nakamura, Takaoka; Hisanaga Furushima, Takaoka, all of Japan

[73] Assignees: Kabushiki Kaisha Nihon Sekkei; Kabushiki Kaisha Azusa Sekkei, both of Tokyo; Tateyama Aruminiumu Kogyo Kabushiki Kaisha, Toyama, all of Japan

[21] Appl. No.: 773,895

[22] Filed: Dec. 27, 1996

[30] Foreign Application Priority Data

| | | | |
|---|---|---|---|
| Dec. 28, 1995 | [JP] | Japan | 7-352418 |
| Jun. 28, 1996 | [JP] | Japan | 8-186912 |

[51] Int. Cl.[6] ..... E06B 5/12

[52] U.S. Cl. ..... 52/1; 49/31; 49/141

[58] Field of Search ..... 52/1; 49/31; 1/141

[56] References Cited

U.S. PATENT DOCUMENTS

| | | | |
|---|---|---|---|
| 3,521,546 | 7/1970 | Day | 52/1 X |
| 3,557,497 | 1/1971 | Schafer et al. | 52/1 |
| 3,757,471 | 9/1973 | Dougherty | 52/1 X |
| 4,104,834 | 8/1978 | Anghinetti et al. | 52/1 |
| 4,144,802 | 3/1979 | Babin | 52/1 X |
| 5,271,189 | 12/1993 | Vincent et al. | 52/1 |

*Primary Examiner*—Christopher Todd Kent
*Attorney, Agent, or Firm*—Evenson, McKeown, Edwards & Lenahan, PLLC

[57] ABSTRACT

A ventilating window for ventilating the interior of a building or a structure such as a vehicle in a natural and gentle manner. A ventilating window for the exhaust of air is provided with a mechanism for automatically opening a window casement when the atmospheric pressure inside the window is higher than the outside atmospheric pressure, thereby dispensing with forced exhaust using a fan or the like. A ventilating window for the supply of air is provided with a mechanism for automatically closing a window casement when the atmospheric pressure outside the window is higher than the inside atmospheric pressure, thereby preventing a strong wind from blowing into the interior. A ventilating window for both exhaust and supply of air is provided with both such opening mechanism and closing mechanism.

17 Claims, 8 Drawing Sheets

VENTILATING WINDOW

BACKGROUND OF THE INVENTION

1. Field of the Invention

The present invention relates generally to a ventilating window for a structure and particularly to the structure of a window for gently ventilating the interior of a structure, or a building, by effectively utilizing natural wind blowing against the building from the exterior or a difference in temperature or atmospheric pressure between the interior and exterior of the building.

2. Related Background Art

Recent buildings, even wooden buildings, are highly airtight and various studies have been made about indoor ventilation. As indoor ventilation methods are known natural ventilation and artificial ventilation.

Natural ventilation methods are broadly classified into ventilation by wind force which uses as a driving force a wind pressure applied to the exterior wall of a building and gravitational ventilation which uses as a driving force a difference in air density based on a temperature difference between the interior and exterior of a building.

The most typical example is such a ventilating duct such as a roof ventilator, which mainly utilizes a suction force induced by external wind. More particularly, a negative-pressure portion is created by wind force to suck the interior air.

However, in the case of a ventilating duct such as a roof ventilator, it is necessary to give a special consideration in the execution of work such as forming an opening in the roof of a building.

On the other hand artificial ventilation uses a mechanical force such as a blower or the like for the intake and/or exhaust of air.

Artificial ventilation using a mechanical force such as a blower easily affords an appropriate ventilation volume constantly, but the electric power consumption of the blower when used over a long period becomes extremely large.

SUMMARY OF THE INVENTION

It is a primary object of the present invention to provide a ventilating window for realizing a gentle natural ventilation in the interior of a building or a structure.

It is another object of the present invention to provide a ventilating window capable of opening or closing automatically in accordance with a difference in atmospheric pressure between the interior and exterior of a building or a structure and thereby effecting natural ventilation even without using a drive source for blast which would cause power consumption.

The ventilating window of the present invention covers ventilating opening structures which are formed through the exterior wall of a building of a relatively high airtightness for the purpose of natural ventilation of the interior of the building, for example, conventional window structures, draft window structures, ventilating window structures and exhaust window structures. "Window casement means" as referred to herein covers plate-like window sashes formed of glass, metal, wood, or plastic material, as well as movable shutters, pivoted window sashes, and movable louvers. Ventilating opening structures with window casement means disposed through the exterior wall of a building are generically called "ventilating window." The "window" as referred to herein covers not only windows for ventilation but also windows for daylighting. A side wall portion of a ventilating room formed on the roof or roof floor of a building may be utilized for a ventilating opening.

According to the present invention, in the first aspect thereof, there is provided a ventilating window comprising a window frame which defines a through opening in a wall of a structure to be ventilated, window casement means which is movable between a first position for opening the through opening and a second position for closing the through opening, and an automatic opening mechanism which moves the window casement means toward the first position for opening the through opening when the window casement means is in the second position and when the atmospheric pressure inside the window is higher than the outside atmospheric pressure.

This ventilating window is suitable for being provided in a leeward wall surface of a structure, or a building. For example, when natural wind blows against a building, there are formed a positive pressure region windward and negative pressure regions on top of the building and leeward, in the exterior of the building. Therefore, if the ventilating window provided with the automatic opening mechanism for moving the window casement means toward the foregoing first position is disposed in the leeward wall surface of the building, then when the atmospheric pressure inside the leeward window becomes higher than the outside atmospheric pressure, the window casement means is opened to the first position automatically. Through the thus-opened window casement means the air present inside the building is drawn out to the negative pressure region formed outside the building, whereby the interior of the building is naturally ventilated in a gentle manner even without performing a forced exhaust using a fan or the like.

The ventilating window in question is also suitable for being provided through at least one exterior wall of a building preferably at an upper position. In the interior of a building there are various heat sources, so the interior usually becomes higher in temperature than in the exterior. Consequently, the interior air expands, becomes light, and moves upward, resulting in that the atmospheric pressure in the upper portion of the interior becomes higher than that of the exterior. According to the present invention, even in such a case, the window casement means is opened automatically to the first position, whereby the interior air is exhausted naturally from the ventilating window and the interior is naturally ventilated in a gentle manner by virtue of a difference in atmospheric pressure based on a temperature difference between the interior and the exterior of the building even without performing a forced exhaust using a fan or the like.

According to the present invention, in the second aspect thereof, there is provided a ventilating window comprising a window frame which defines a through opening in a wall of a structure to be ventilated, window casement means which is movable between a first position for opening the through opening and a second position for closing the through opening, and an automatic closing mechanism which moves the window casement means toward the second position for closing the through opening when the window casement means is in the first position and when the atmospheric pressure outside the window is higher than the inside atmospheric pressure.

This ventilating window is suitable for being provided in a windward wall surface of a structure, or a building. For example, when natural wind blows against a building, there are formed a positive pressure region windward and negative pressure regions on top of the building and leeward, in the exterior of the building. Therefore, if the ventilating window equipped with the automatic closing mechanism for moving the window casement means toward the second position is disposed in the windward wall surface of the building, then when the atmospheric pressure outside the leeward window is higher than the inside atmospheric pressure, the window casement means is closed automatically to the second position, whereby the interior is shielded from the outside air without blowing of a strong wind into the interior.

The ventilating window in question is also suitable for being provided through at least one exterior wall of a building, preferably at a lower position. For example, even when the wind is not blowing, if the atmospheric pressure outside the window becomes higher than the inside atmospheric pressure due to cooling in the interior, the interior is shielded from the exterior by means of the ventilating window.

By applying the ventilating windows in the first and second aspects of the present invention described above in combination with each other to a building, it is made possible to effect a gentle, natural ventilation of the building in a more effective manner.

More specifically, according to the present invention, in the third aspect thereof, there is provided a combination of a first ventilating window and a second ventilating window, the first ventilating window comprising first window casement means which is movable between a first open position and a first closed position, and an automatic opening mechanism which moves the first window casement means toward the first open position when the first casement means is in the first closed position and when the atmospheric pressure inside the first ventilating window is higher than the outside atmospheric pressure, and the second ventilating window comprising second window casement means which is movable between the second open position and the second closed position, and an automatic closing mechanism which moves the second window casement means toward the second closed position when the second window casement means is in the second open position and when the atmospheric pressure outside the second ventilating window is higher than the inside atmospheric pressure.

According to one concrete mode of the above combination, the first ventilating window is provided in a first wall of a structure to be ventilated, while the second ventilating window is provided in a second wall opposed to the first wall.

According to another concrete mode of the above combination, the first ventilating window is provided at an upper position of a wall of a structure to be ventilated, while the second ventilating window is provided at a lower position of the wall.

According to a still further concrete mode of the above combination, the first ventilating window is provided at an upper position of a first wall of a structure to be ventilated, while the second ventilating window is provided at a lower position of a second wall of the structure.

According to the present invention, in the fourth aspect thereof, there is provided a ventilating window comprising a window frame which defines a through opening in a wall of a structure to be ventilated, window casement means which is movable between a first position for opening the through opening and a second position for closing the through opening, an automatic opening mechanism which moves the window casement means toward the first position for opening the through opening when the window casement means is in the second position and when the atmospheric pressure inside the window is higher than the outside atmospheric pressure, and an automatic closing mechanism which moves the window casement means toward the second position when the window casement means is in the first position and when the atmospheric pressure outside the window is higher than the inside atmospheric pressure.

Thus, the ventilating window in the fourth aspect of the invention is provided with both the automatic opening mechanism as a characteristic element in the first aspect and the automatic closing mechanism as a characteristic element in the second aspect. Therefore, when the inside atmospheric pressure is higher than the outside atmospheric pressure, the window casement means is opened toward the first position, while when the outside atmospheric pressure is higher than the inside atmospheric pressure, the window casement means is closed toward the second position.

The ventilating window in the fourth aspect of the invention is suitable for being provided in each of two, opposed, exterior wall surfaces of a building. For example, the direction of natural wind varies with time or according to seasons. However, when natural wind blows against a building, there are formed a positive pressure region windward and negative pressure regions on top of the building and leeward, in the exterior of the building. Consequently, in the ventilating window positioned leeward, the inside atmospheric pressure becomes higher than the outside atmospheric pressure, while in the ventilating window located windward the outside atmospheric pressure becomes higher than the inside atmospheric pressure. In the ventilating window in question, even when the wind direction changes, the leeward window functions so as to be opened, while the windward window functions so as to be closed, so that on the one hand, the windward ventilating window is closed automatically to prevent a strong wind from blowing into the interior and thus the interior is shielded from the outside air, and on the other hand, the interior air is sucked from the open ventilating window located leeward to the negative pressure region formed outside the window. In this way the interior is naturally ventilated in a gentle manner even without performing a forced exhaust using a fan or the like.

Preferably, the ventilating window in the fourth aspect is provided through one or more exterior walls of a building at upper and lower positions. In the interior of a building there are various heat sources, so the interior usually becomes higher in temperature than the exterior. Consequently, the air in the interior expands and becomes light, then moves upward, so that the atmospheric pressure at the upper portion of the interior becomes higher than the outside atmospheric pressure. According to the present invention, even in such a case, the window casement means disposed at an upper position is opened and the interior air is exhausted naturally through the ventilating window. When the interior atmospheric pressure becomes lower than the exterior atmospheric pressure due to cooling, the ventilating window is closed automatically by the window casement means.

The automatic opening mechanism or the automatic closing mechanism may be of the type in which the window casement is opened or closed automatically by power or of the type in which the window casement is opened or closed by utilizing as a direct driving force a difference in atmospheric pressure between the interior and the exterior of the building.

The automatic opening or closing mechanism using a mechanical driving comprises sensor means for detecting a difference in atmospheric pressure between the inside and outside of the window, control means which, when the inside atmospheric pressure is found to be higher than the outside atmospheric pressure by the sensor means, generates a first command for opening the foregoing through opening and, when the outside atmospheric pressure is higher than the inside atmospheric pressure, generates a second command for closing the through opening, and drive means for moving the window casement means to the second position when the second command has been issued from the control means.

There may be adopted a construction in which wind sensor means for detecting the direction of wind against the structure is used instead of the sensor means for detecting a difference in atmospheric pressure between the inside and outside of the window, the first command for opening the through opening is issued by the control means when the window is located leeward and the second command for closing the through opening is issued by the control means when the window is located windward, and in accordance with these commands the window casement means located in the second position is moved toward the first position, while the window casement means located in the first position is moved toward the second position.

In the case where the automatic opening or closing mechanism is of the type which utilizes as a direct driving force a difference in atmospheric pressure between the interior and exterior of the building, the window casement means has a substantially flat surface and is pivotally connected to the window frame so as to be pivotable about a horizontal pivot shaft offset to position where the surface is divided into two surface portions of unequal areas, further, the window casement means is provided with counterbalancing means for substantially balancing static loads between the two divided surface portions.

In this case, the areas on both sides of the horizontal pivot shaft of the window casement means are usually unequal. In the case of a leeward window of a building or when the interior air has been warmed, the atmospheric pressure inside the window becomes higher than the outside atmospheric pressure, while in the case of a windward window of a building, the atmospheric pressure outside the window becomes higher than the inside atmospheric pressure. Such differences in atmospheric pressure act uniformly on the whole surface of the window, so the larger the working area, the larger the force acting on the window. The difference in the working force acts as a moment force for rotating the window casement means, whereby the window casement means is opened or closed.

In connection with the use of mechanical drive means in each of the foregoing aspects of the invention, use was made of an atmospheric pressure difference as a start to perform the opening or closing motion of the window casement means, the atmospheric pressure difference may be substituted by a detected direction and/or degree of wind against each of opposed exterior wall portions of the building as a start to perform the motions. In this case, in accordance with the result of detection provided from wind sensor means for detecting the direction and force of wind, the control means provides the first command for opening the foregoing through opening to the drive means when the window is located leeward, while when the window is located windward, the control means provides the second command for closing the through opening to the drive means. The drive means, upon receipt of the first command, moves the window casement means located in the second position toward the first position, while upon receipt of the second command, the drive means moves the window casement means located in the first position toward the second position.

In the case of this mechanical drive means, it is also possible to perform the opening motion by using such a power source as an electric motor. In this case, the construction of the window casement opening and closing mechanism becomes simpler as compared with the sliding door type insofar as there are provided a window frame through the exterior wall of the building and a flat plate-like window casement means mounted to the window frame pivotably through a horizontal pivot shaft. As to the exhaust of air present in the interior and intake of air from the exterior, the upper window opening can be used for the exhaust of air and the lower window opening for the intake of air, with the horizontal pivot shaft and the vicinity thereof as a neutral region. Thus, it is possible to effect natural ventilation of the interior in a gentle manner.

In this case, moreover, since the window casement means is opened and closed by a mechanical force, the position of the horizontal pivot shaft is not limited to the position of equally dividing the window casement surface.

In the use of the ventilating window according to the present invention, when there is no difference in atmospheric pressure between the inside and outside of the window, including a windless state, the ventilating window should be opened from the standpoint of interior ventilation. Therefore, in the case of using mechanical drive means for opening and closing the window as referred to above, it is preferred that, when there is no difference in atmospheric pressure between the inside and outside of the window (neutral condition), including a windless state, a command for opening the window casement means is provided from the control means to the drive means in accordance with the results of detection provided from the sensor means.

In the case of using an atmospheric pressure difference as a direct driving force for opening and closing the window, a counter balance is attached to the window casement means in a protruding fashion to the interior side and the centroid position of the window casement means, including the counter balance, is displaced from the pivotal axis to either the interior side or the exterior side, whereby in the neutral state the window casement means is balanced in its open condition. By so doing, without any artificial or mechanical operation, the window casement means can be held in its open condition when there is no wind for example.

When the window casement means is in its open condition, it preferably takes a predetermined angle relative to the window frame. This is because if the opening motion range of the window casement means is widened limitlessly, its operation stroke becomes large and its reaction to natural wind or a difference in atmospheric pressure becomes dull. Besides, by limiting the operation stroke of the window casement means there is obtained an advantage that the interior moving space occupied by the window casement means does not become large to an unnecessary extent.

Preferred to this end is stopper means which restricts the pivotal motion of the window casement means around the horizontal pivot shaft to a predetermined angular range. This can be realized by a mechanical structure which prevents the window casement means from opening to a larger extent than a predetermined angle. The magnitude of the pivotal motion (opening motion) of the window casement means relative to the window frame depends on the extent of receiving natural wind in a satisfactory manner when the wind is blowing. That is, the magnitude depends on the conditions of location of a building to be ventilated. Once the window casement means assumes a completely horizontally open condition, the use of mechanical drive means is essential because the window casement means can no longer be closed automatically even if natural wind blows. Conversely, if the window casement means is opened at an angle close to its standing state, it becomes difficult to effect natural interior ventilation because of a narrow opening width. In view of this point a suitable tilting angle of the window casement means in its open condition from the vertical direction is selected preferably in the range of 30 to 60 degrees. In order for the window casement means to be closed automatically by the wind pressure of natural wind, it is desirable to adopt a construction in which, when the window casement means is opened, the wider surface out of the surface portions present on both sides of the horizontal pivot shaft tilts always to the exterior side. Taking into account both the exhaust efficiency of the window in its open condition and the angle of the surface of the window casement means which receives window from the exterior, the maximum tilting angle of the window casement means is, most suitably, about 45 degrees relative to a vertical plane.

The foregoing stopper has an abutment portion for abutment with the window casement means upon opening of the same means up to a suitable, maximum open angle. The opening motion of the window casement means is restricted to an angular range up to abutment thereof against the stopper. It is preferable that the abutment portion of the stopper be provided with buffer means for absorbing the shock resulting from abutment therewith of the window casement means. For example, when it is blowing hard, a strong impact or a loud sound will be generated upon abutment of the window casement means against the stopper at the final stage of the opening motion, and some trouble or damage of a bearing used in the window casement means may result. But this can be avoided by using the buffer means.

In the case of utilizing a difference in atmospheric pressure as a driving force for opening and closing the window, there will arise a flapping problem of the window under extremely severe weather conditions such as a typhoon or a heavy rain. In this connection, it is desirable to use lock means for fixing (or locking) the window casement means in its closed position. There may be further used lock control means for fixing the window casement means forcibly to the foregoing second position when the difference in atmospheric pressure or wind force detected by the foregoing sensor means has exceeded a predetermined threshold value.

According to the present invention, in a still further aspect thereof, there is provided a ventilating window which, in combination with the ventilating window in the foregoing fourth aspect, is further provided with weather condition sensor means for detecting any one or more of wind direction, wind pressure, air temperature, humidity, weather, in the exterior of a building, and a difference in atmospheric pressure between the interior and exterior of the building, and lock control means for fixing the window casement means to its closed condition when the result of detection obtained by the weather condition sensor means has exceeded a preset value.

Preferred embodiments of the present invention will be described in detail hereinafter with reference to the accompanying drawings. It is to be understood that the following embodiments are for illustration purposes only and that the present invention is not limited thereto.

DESCRIPTION OF THE PREFERRED EMBODIMENTS

Figure 1:
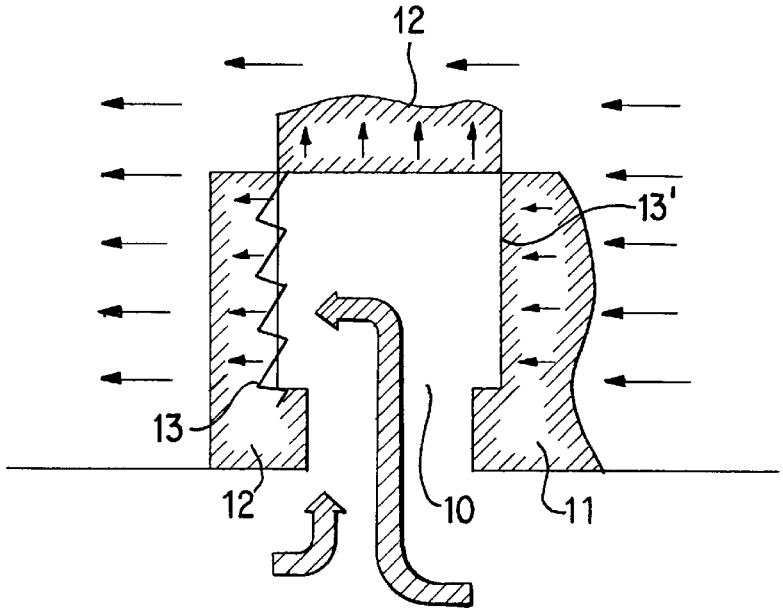
FIG. 1 is a diagram showing a principle of ventilation in an example wherein ventilating windows according to the present invention are mounted in a building.

In FIG. 1, a highly airtight building 10 is equipped with ventilating windows 13 and 13' in wall surfaces opposed to each other. As shown in the same figure, when natural wind blows in the arrowed direction against the building 10, a positive pressure region 11 is formed windward, and negative pressure regions 12 are formed on top of the building and leeward, in the exterior of the building. The ventilating window 13 which is located leeward is provided with an automatic opening mechanism. When the atmospheric pressure inside the ventilating window is higher than the outside atmospheric pressure, the automatic opening mechanism causes casements of the window to open at a predetermined angle relative to the frame of the window. In this example, a plurality of flat plate-like casements of the leeward ventilating window 13 are in an open condition because the inside atmospheric pressure is higher than the outside atmospheric pressure.

On the other hand, the ventilating window 13', which is located windward, is provided with an automatic closing mechanism which closes the window casements when the outside atmospheric pressure is higher than the inside atmospheric pressure. In the illustrated example, casements of the windward ventilating window 13' are in a closed condition because the inside atmospheric pressure is lower than the outside atmospheric pressure due to wind pressure acting on the window casements.

By such opening and closing motions of the ventilating windows 13 and 13' based on such difference in atmospheric pressure in each of the windows, the air present in the interior flows out to the exterior through the ventilating window 13 which is in an open condition, while the inflow of the outside air is prevented by the closed ventilating window 13'. In this way the interior is ventilated naturally in a gentle manner.

The direction of wind around a building may vary periodically depending on the conditions of location of the building, for example whether the building is located near the sea or near a mountain, and also depending on time. In the case of a building having such conditions of location, both ventilating windows 13 and 13' may be disposed on each of both opposed wall surfaces.

In many cases, the wind direction around a building varies randomly every moment. In such a case, ventilating windows each provided with both of the foregoing automatic opening mechanism and automatic closing mechanism may be disposed in a plurality of appropriate positions of the exterior walls throughout the whole circumference of the building.

More specifically, in a ventilating window provided with both such automatic opening and closing mechanisms, when the atmospheric pressure inside the window is higher than the outside atmospheric pressure, casements of the window are opened automatically at a predetermined angle relative to the window frame by the automatic opening mechanism, while when the inside atmospheric pressure is lower than the outside atmospheric pressure, the window casements are closed automatically by the automatic closing mechanism. If such ventilating windows are disposed both windward and leeward of a building, then even with a change in the direction of wind, each ventilating window performs an opening or closing motion accordingly, and thus it is possible to effect a natural ventilation of the interior automatically and effectively.

Figure 2A:
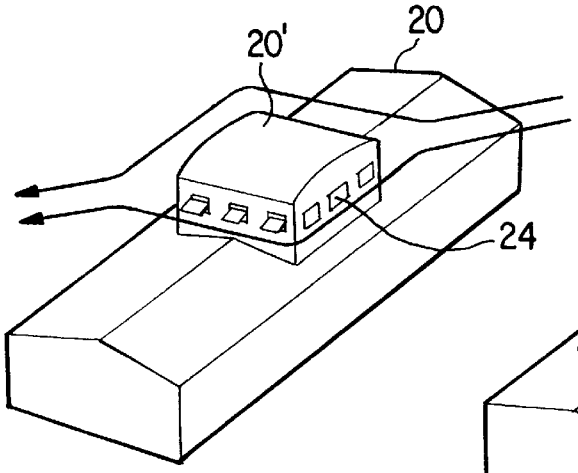
FIGS. 2*a* and 2*b* are diagrams each showing an entire construction conceptually in another example wherein ventilating windows according to the present invention are mounted in a building.
Figure 2B:
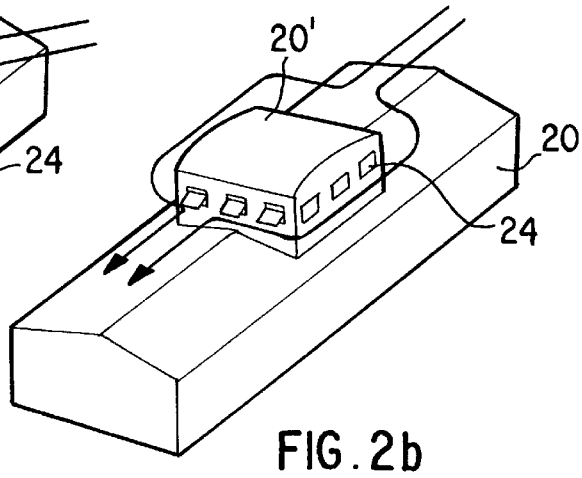

In the example shown in FIGS. 2*a* and 2*b*, a roof floor structure 20' for ventilation is mounted on the roof of a highly airtight building 20, and a plurality of ventilating windows 24 are disposed in the exterior wall surfaces of the front, rear and right, left sides of the structure 20'. Each of the ventilating windows 24 is provided with the foregoing automatic opening mechanism and automatic closing mechanism. Since the ventilating windows perform an opening or closing motion each individually according to a difference in atmospheric pressure between the interior and the exterior of the building, the interior is maintained in a satisfactory condition of natural ventilation even if the direction of wind changes from the state shown in FIG. 2*a* to the state shown in FIG. 2*b*.

Such automatic opening and closing operations may be done by using a power source such as an electric motor for example, or by using as a direct power a wind pressure exerted on the surface of each ventilating window in a building or a difference in atmospheric pressure between the inside and outside of the building and thereby changing the moment balance of window casements. Further, for ensuring the opening or closing motion of each ventilating window, the same motion may be started in accordance with a difference in atmospheric pressure detected by sensor means.

Figure 3:
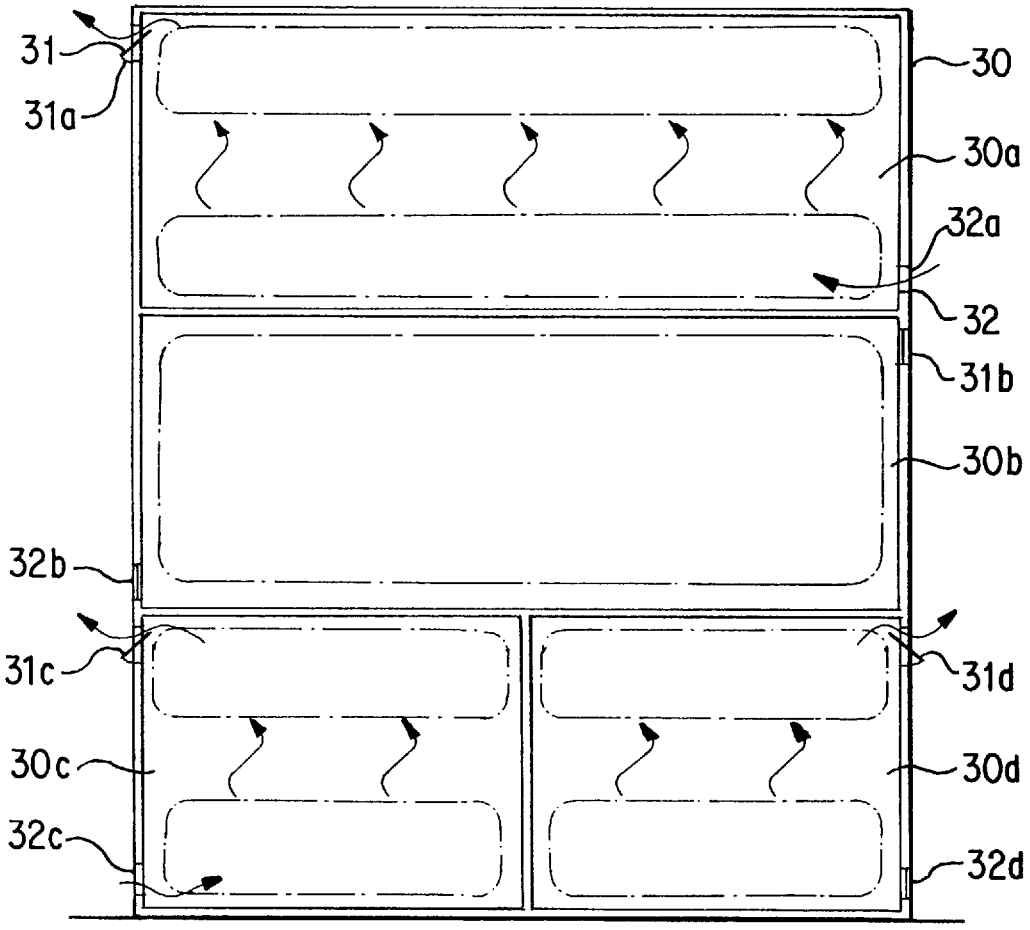
FIG. 3 is a diagram showing a principle of ventilation in a further example wherein ventilating windows according to the present invention are mounted in a building.

FIG. 3 shows conceptually an example of a ventilating window for naturally ventilating the interior of a highly airtight building in accordance with the principle of a gravitational ventilation which utilizes as a motive power a temperature difference (i.e., air density difference) between the interior and exterior of a building. As is often the case with the ordinary style of buildings, the interior space of the building in this example is partitioned into three floors; basement, second floor and third floor. In the rooms of these floors are usually present various heat sources and therefore the inside air usually becomes higher in temperature than the outside air. The air present inside those rooms including heat sources expands and becomes light, then moves upward, so that in the upper space of each floor there exists the expanded and light air, which is adjacent to the outside lower-temperature and heavy air through walls and windows.

As shown in FIG. 3, in a highly airtight three-storied building 30, rooms 30*a*, 30*b*, 30*c* and 30*d*, formed on the three floors respectively are each provided with an upper window 31 and a lower window 32 which are mounted through exterior walls of the building. A casement of the upper window 31 is opened by the automatic opening mechanism when there is no difference in atmospheric pressure between the interior and exterior of the building and also when the interior atmospheric pressure is higher than the exterior atmospheric pressure, while when the interior atmospheric pressure is lower than the exterior atmospheric pressure, the window casement is closed by the automatic closing mechanism. On the other hand, a casement of the lower window 32 is usually opened or closed manually and arbitrarily. This is because the lower window is usually located at a reachable height, while the upper window is located near the ceiling beyond a person's reach and thus requires the automatic opening and closing mechanisms. Particularly in large-sized buildings such as factories and halls, the upper window is positioned high and is greatly influenced by the difference in atmospheric pressure between the interior and the exterior induced by heat. The example in question is effective in such a case.

Now, in the room 30*a* on the third floor, the inside air is warmed by various heat sources present in the room and light air is distributed in the upper portion, while heavy air distributed in the lower portion. As a matter of course, the upper air is lighter than the outside air and the interior atmospheric pressure in this portion is higher than the outside atmospheric pressure, so that the casement of the upper window 31*a* is opened and the upper light air is discharged to the exterior naturally from the upper window 31*a*. At this time, if the lower window 32*a* is opened manually, the outside air is sucked into the interior through the lower window 32*a* by virtue of an air current induced in the interior as a result of exhaust from the upper window 31*a*.

Also in the left-hand room 30*c* on the first floor the air present in the upper portion of the room is discharged from an upper window 31*c* and fresh outside air is supplied into the room through a lower window 32*c*.

In the room 30*b* on the second floor, in which cooling is being performed or there is no heat source, the outside temperature may be higher than the inside temperature in a manually closed state of a lower window 32*b*. In this state, the atmospheric pressure in the room 30*b* becomes lower than the outside atmospheric pressure, so that the casement of an upper window 31*b* is closed to cut off the air communication between the outside and the interior of the room 30*b*.

In the right-hand room 30*d* on the first floor, the inside temperature is higher than the outside temperature in a closed state of a lower window 32*d*. In this case, the atmospheric pressure in the upper portion of the room becomes higher than the outside atmospheric pressure, so that the casement of an upper window 31*d* is opened and the light air present in the upper portion is discharged from the upper window 31*d*, but the ventilation in the interior of the room 30*d* is performed in a gentle manner because the lower window 32*d* is in a closed condition.

Figure 4A:
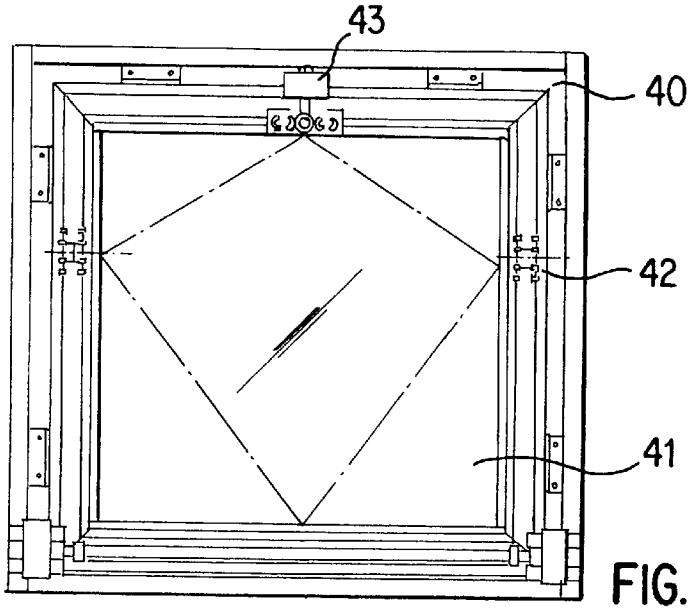
FIG. 4*a* is a side view showing a construction of a ventilating window according to an embodiment of the present invention.
Figure 4B:
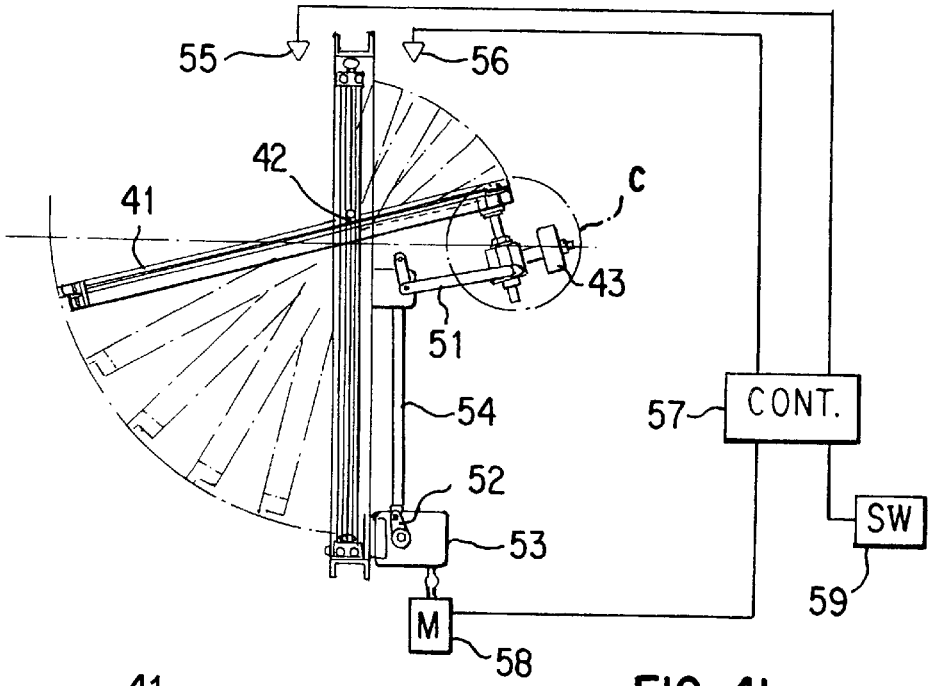
FIG. 4*b* is a front view thereof.
Figure 4C:
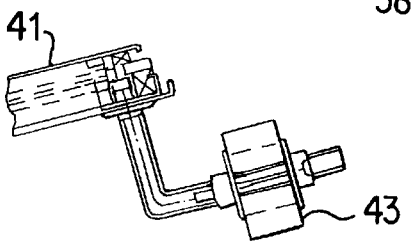
FIG. 4*c* is an enlarged view of an encircled portion C in FIG. 4*b;*

FIGS. 4*a* to 4*c* and FIG. 5 show a ventilating window according to an embodiment of the present invention. This ventilating window has a mechanism which opens and closes a window casement by a mechanical force. As shown in FIGS. 4*a* and 4*b*, a window frame 40 is mounted in an upright wall surface and a flat plate-like window casement 41 is secured to the window frame 40 pivotably through a horizontal pivot shaft 42. Atmospheric pressure sensors 55 and 56 for detecting atmospheric pressures are respectively mounted outside and inside the wall.

To the interior-side upper end of the window casement 41 is attached a weight 43 as a counter balance through an L-shaped mounting piece so as to project upward from the upper edge of the window casement. The horizontal pivot shaft 42 is located in a position where an upper rotational moment (clockwise downward in FIG. 4*a*) of the window casement 41 loaded with the weight 43 and a lower rotational moment (clockwise upward in FIG. 4*b*) are substantially balanced. Accordingly, with a relatively small force, the window casement 41 is freely pivotable about the horizontal pivot shaft 42. Further, since the weight 43 is located at a higher position than the upper edge of the window casement, not only the rotational moments can be balanced by the use of a small weight, but also the protruding length in an out-of-plane direction can be reduced.

Figure 5:
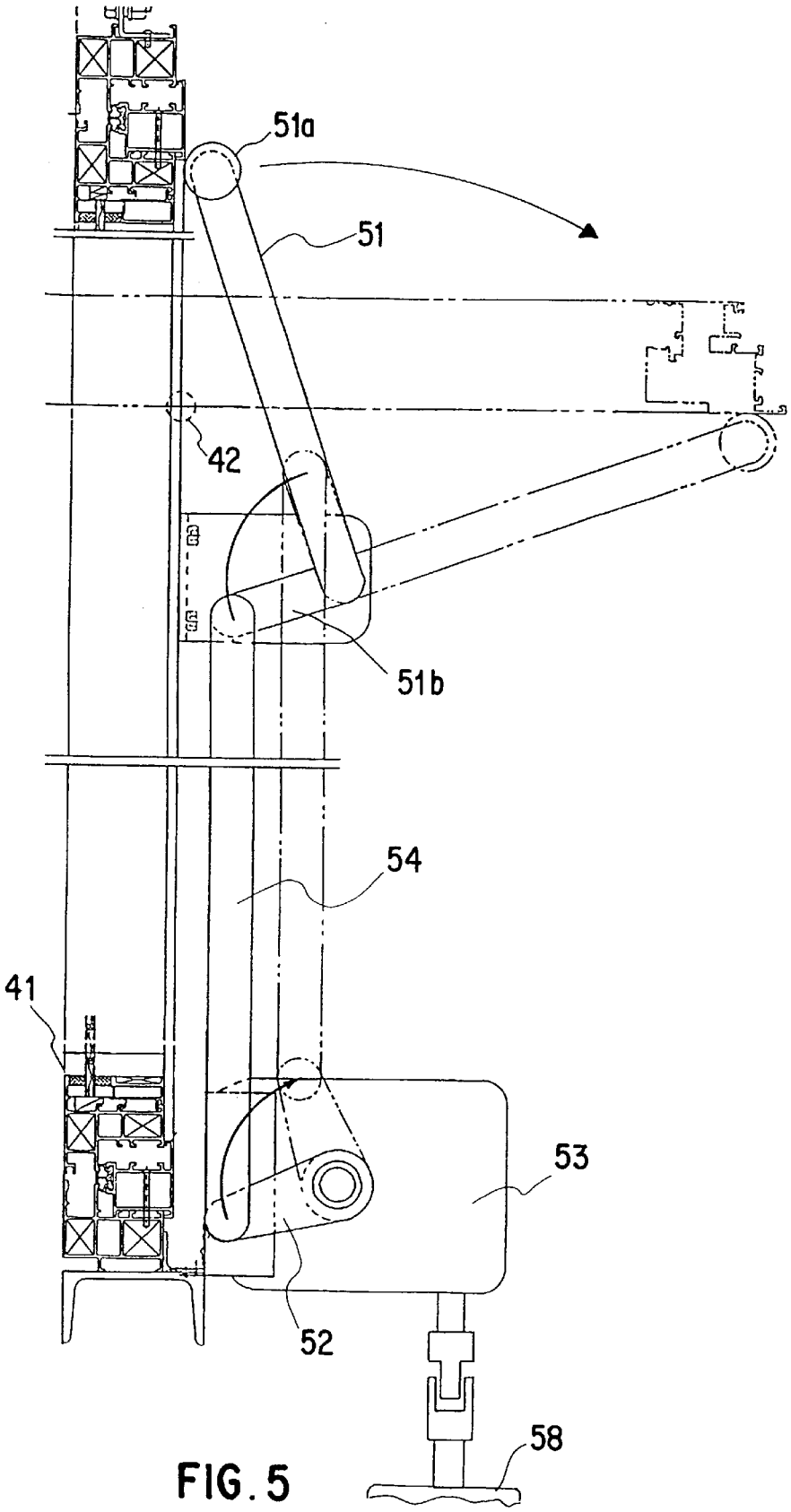
FIG. 5 is a diagram showing a detailed construction of a principal portion in FIG. 4*b;*

In association with the window casement 41, as window casement driving means for rotating the window casement in a predetermined angular range relative to the window frame 40, there are provided, as shown in FIGS. 4*b* and 5, an L-shaped arm 51 having an L-shaped front end portion 51*a* connected to an upper position of the window casement 41 and also having an L-bent portion 51*b* connected pivotably to the window frame, a driving arm 52, a power box 53 for imparting an angular motion to the driving arm 52, a driving motor 58 for driving the power box 53, and a connecting rod 54 for transmitting the angular motion of the driving arm 52 to the L-shaped arm 51. The connecting rod 54 is connected to the L-bent portion 51*b* of the L-shaped arm 51.

Detection results provided from the atmospheric pressure sensors 55 and 56 are fed to an arithmetic and control unit 57 which functions as both atmospheric pressure difference detector and window casement control means. The arithmetic and control unit 57 detects a difference between the atmospheric pressure at the inside of the window and the atmospheric pressure at the outside of the window. When the inside atmospheric pressure is higher than the outside atmospheric pressure in a closed state of the window casement 41, the arithmetic and control unit 57 provides a command for forward rotation to the driving motor 58 for the power box 53 to open the window casement 41. On the other hand, when the outside atmospheric pressure is higher than the inside atmospheric pressure in an open condition of the window casement, the arithmetic and control unit 57 provides a command for reverse rotation to the driving motor 58 to close the window casement 41. Whether the window casement 41 is open or closed is detected on the basis of stored final state data in the operations so far made or by the use of a pilot switch (not shown) attached to the window frame 40.

Instead of the atmospheric pressure sensors 55 and 56 disposed inside and outside the building there may be used wind sensor means for detecting the direction of wind and/or wind force against exterior walls opposed to each other of the building. In this case, the wind sensor means detect whether there is no wind, or a favorable wind is blowing, or an adverse wind is blowing, then if it is determined from the result of the detection that the atmospheric pressure at the inside of the window is higher than the outside atmospheric pressure, the window casement control means is required to issue a command for opening the window casement, while if it is determined that the outside atmospheric pressure is higher than the inside atmospheric pressure, the control means is required to issue a command for closing the window casement.

There may be used a change-over switch 59 for selecting and executing only the function of opening or closing the window casement 41. With the change-over switch 59, when there is no wind or when the inside atmospheric pressure is higher than the outside atmospheric pressure, the window casement 41, if closed, is opened in accordance with a forward rotation command for the motor 58. Likewise, when the outside atmospheric pressure is higher than the inside atmospheric pressure, the window casement 41, if opened, is closed in accordance with a reverse rotation command for the motor 58.

In this embodiment the horizontal pivot shaft 42 is offset upward in the window casement plane, the window casement 41 is pivotally supported by the pivot shaft 42, and moment balance is adjusted by using the weight 43 as a counter balance. However, in the case where the window casement 41 is opened and closed by a mechanical power such as an electric motor, the weight 43 need not be used, and the horizontal pivot shaft may be dispoded at a vertical position where the surface of the window casement 41 is equally divided into two.

Figure 6:
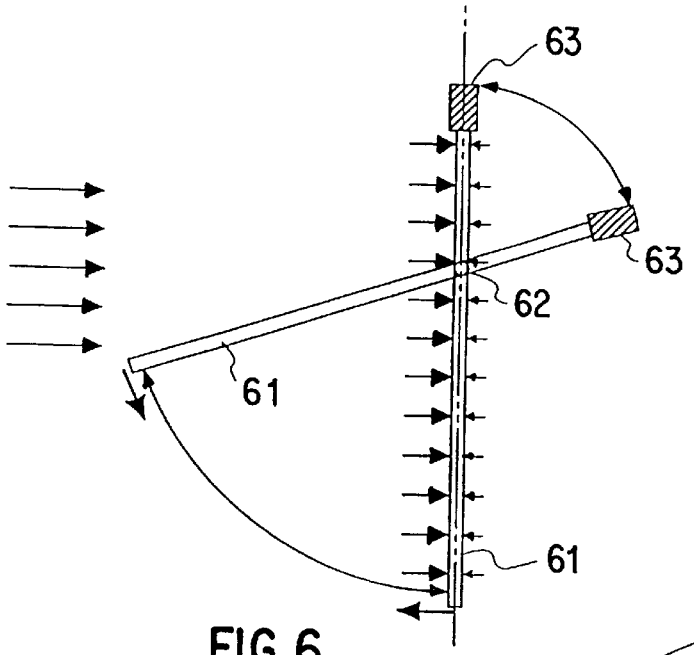
FIG. 6 is a diagram showing a ventilating window according to another embodiment of the present invention.

Referring now to FIG. 6, there is illustrated a ventilating window according to another embodiment of the present invention, in which wind force or a difference in atmospheric pressure between the interior of a building and the exterior is utilized as the power for opening and closing a window casement. More specifically, a casement 61 of the ventilating window of this embodiment is pivotally secured to a window frame (not shown) through a horizontal pivot shaft 62 which is offset upward in the window casement plane. At the upper end of the window casement 61 is disposed a weight 63 as a counter balance, and the horizontal pivot shaft 62 is disposed in a position where a rotational moment (clockwise downward in FIG. 6) of the upper portion of the window casement loaded with the weight 63 and a rotational moment (clockwise upward in FIG. 6) of the lower portion, with respect to the pivot shaft, are substantially balanced each other. Accordingly, with a small force, the window casement 61 is pivotable about the horizontal pivot shaft 62.

In this embodiment, the horizontal pivot shaft 62, which is pivotally secured to the window frame, is offset upward and the weight 63, which corresponds to the degree of offset, is fixed to the upper end of the window casement to substantially balance the rotational moment of the upper portion and that of the lower portion with respect to the pivot axis. More particularly, with the horizontal pivot shaft 62 as a boundary, the area of the upper portion of the window casement and that of the lower portion are unequal. Therefore, when wind blows against the window casement 61 or when there occurs a difference in atmospheric pressure between the inside and outside of the window casement 61, there is developed a rotating force for rotating the window casement 61 in proportion to the difference in area between the two surfaces of the window casement divided by the horizontal pivot shaft 62.

As shown in FIG. 6, therefore, when wind blows in the arrowed direction toward the window casement 61 which is open, the surface whose wind receiving area is larger undergoes the action of a stronger force, and the difference in this working force acts as a moment force for rotating the window casement, whereby the window casement 61 turns in the direction to close the window. When the window casement 61 is closed and if in this state there occurs a difference in atmospheric pressure between the inside and outside of the window casement, the surface which is the larger in the atmospheric pressure acting area undergoes the action of a stronger force, and the difference in this working force serves as a moment force for rotating the window casement, whereby the window casement 61 turns in the direction to open the window. Thus, that the two surfaces of the window casement 61 divided by the horizontal pivot shaft 62 are unequal brings about the function as a closing or opening mechanism of the window casement.

Figure 7:
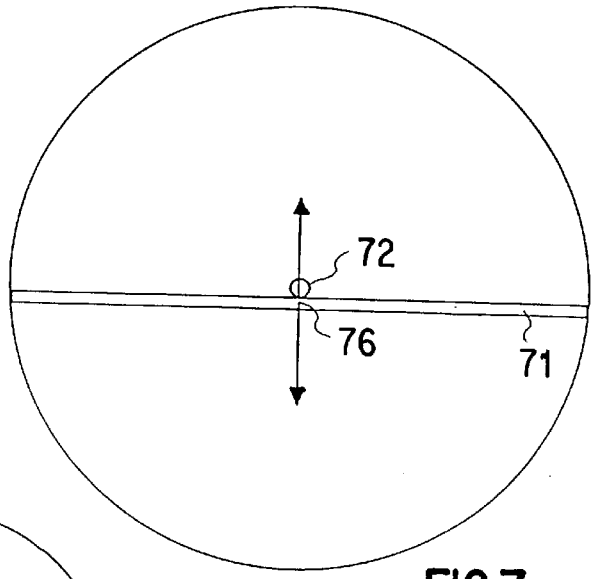
FIG. 7 is a diagram showing a ventilating window according to a further embodiment of the present invention.

On the other hand, FIG. 7 illustrates a mechanism for opening a window casement in a windless condition. In the illustrated embodiment there is shown a sideways motion of the window casement. More specifically, a flat plate-like casement 71 of a ventilating window according to this embodiment is pivotally secured to a window frame (not shown) through a horizontal pivot shaft 72. The horizontal pivot shaft 72 is located in a position deviated from the position of the center of gravity 76 of the window casement 71 (in FIG. 7 showing a horizontal state of the window casement 71, the horizontal pivot shaft 72 is positioned just above the center of gravity 76).

Therefore, when there is no external force exerted on the window casement 71, the window casement is opened so that its center of gravity 76 lies just under the horizontal pivot shaft 72, and comes to a standstill. In the presence of an external force, a restoring force which acts to return to the open condition (i.e., standstill condition of the window casement) increases according to the distance (height) between the fulcrum (i.e., the horizontal pivot shaft) and the gravitational position of the whole of the window casement 71. As necessary, therefore, the horizontal pivot shaft may be disposed in a position where the window casement is closed with a small force such as natural wind.

Figure 8:
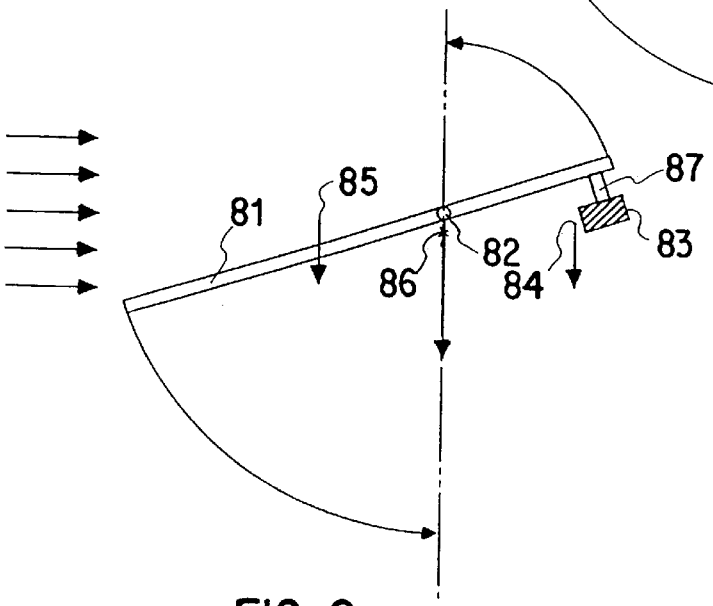
FIG. 8 is a diagram showing a ventilating window according to a still further embodiment of the present invention.

FIG. 8 illustrates a ventilating window according to a still further embodiment of the present invention. This ventilating window, for opening and closing motions of a window casement, utilizes a wind force or a difference in atmospheric pressure between the inside and outside of a building. When there is no difference in atmospheric pressure, the window casement is opened.

More specifically, the window casement, indicated by 81, of the ventilating window according to this embodiment is secured to a window frame (not shown) pivotably through a horizontal pivot shaft 82 only in an angular range of the arrow A in the figure. To the upper end portion of the window casement 81 is connected a weight 83 as a counter balance through a connecting rod 87 projecting to the interior side. The horizontal pivot shaft 82 is secured to the window frame in a position which is offset upward in the window casement plane. The position is selected in such a manner that a rotational moment (clockwise downward in FIG. 8 relative to the opening direction) of the upper portion, with respect to the pivot shaft, of the window casement loaded with the weight 83 which depends on the degree of the offset, and a rotational moment (clockwise upward in FIG. 8 relative to the opening direction) of the lower portion, are substantially balanced each other. Accordingly, with a small force, the window casement 81 is pivotable about the pivot shaft 82. With the pivot shaft 82 as a boundary, the area of the upper portion of the window casement and that of the lower portion are unequal, the latter being larger than the former. Strictly speaking, the position level of the pivot shaft 82 is selected so as to be always higher than the position of the center of gravity 86 of the entire window casement including the weight 83. When there is no other external force than gravity, therefore, the window casement 81 comes to a stand still in its open condition, while when an external force is exerted thereon, the window casement turns in its closing direction about the horizontal pivot shaft 82.

In this case, against the force of wind acting on the window casement 81 from the exterior in a direction to turn and close the window casement which is in an open condition, a force (called "restoring force") acting to hold the window casement 81 in the original open condition increases according to an increase in the distance between the fulcrum, i.e., the horizontal pivot shaft, and the centroid position of the window casement. Thus, the selection of a suitable position level of the horizontal pivot shaft 82, as well as a suitable mass of the weight 83 and a suitable length of the connecting rod 87 (the degree of projection of the weight 83 to the interior side), is important for obtaining a restoring force of a magnitude proportional to the strength of natural wind which depends on the conditions of location.

In the embodiment shown in FIG. 8, when wind blows in the arrowed direction against the window casement 81 which is in an open condition, or when the atmospheric pressure in the exterior becomes higher than the atmospheric pressure in the interior, a stronger force (advancing toward the interior) is developed in the lower portion of the window casement with the horizontal pivot shaft 82 as a boundary which lower portion has a larger area of pressure exertion thereon from the exterior, out of both upper and lower portions, and by virtue of a counterclockwise rotation moment created by the difference between the force developed in the lower portion and the force developed in the upper portion, the window casement 81 is turned in its closing direction. On the other hand, when there is little difference in atmospheric pressure between the inside and outside of the window casement 81 which is in a closed condition, there arises a state in which no other external force than gravity is exerted on the window casement, as mentioned previously, so that the window casement reverts to the open condition. When the atmospheric pressure inside the window casement 81 in a closed condition becomes higher than the outside atmospheric pressure, a stronger force (advancing toward the exterior) is developed in the lower portion of the window casement which portion has a larger area of pressure exertion thereon from the interior, and the resulting clockwise rotation moment causes the window casement 81 to turn in its opening direction.

In this embodiment, a full open angle of the window casement is selected in an angular range in which there occurs a rotational moment in the foregoing closing direction when natural wind blows. A full open angle at which the window casement becomes completely horizontal should not be selected. This is because at that angle the window casement cannot be closed automatically even when natural wind blows. Conversely, a too small full open angle of the window casement will make it difficult to effect natural ventilation in the interior of a building to a satisfactory extent. In view of these points, a full open angle of the window casement is selected preferably in the range of 30 to 60 degrees, more preferably it is 45 degrees. In order that the window casement may not turn beyond the thus-selected full open angle, a stopper for restricting the rotational range of the window casement is provided on the window frame or on the bearing portion for supporting the window casement.

In the case of a ventilating window having both automatic opening mechanism and automatic closing mechanism, a too high response characteristic of the window casement in its opening and closing motions will induce the opening or closing motion at every change of a weak wind. Conversely, if the response characteristic is too low, the opening and closing motions of the window casement will become less reliable. For avoiding this inconvenience, it is effective to use a position adjusting mechanism which causes the position of the foregoing weight relative to the window casement to be changed in accordance with the open angle of the window casement relative to the window frame. With the position adjusting mechanism it is possible to change the shift range of the centroid position of the window casement relative to the horizontal pivot shaft and thereby adjust the response characteristic in the opening and closing motions. A suitable example of the position adjusting mechanism is shown in FIGS. 9*a*, 9*b*, 10, 11, 12*a*, and 12*b*.

Figure 9A:
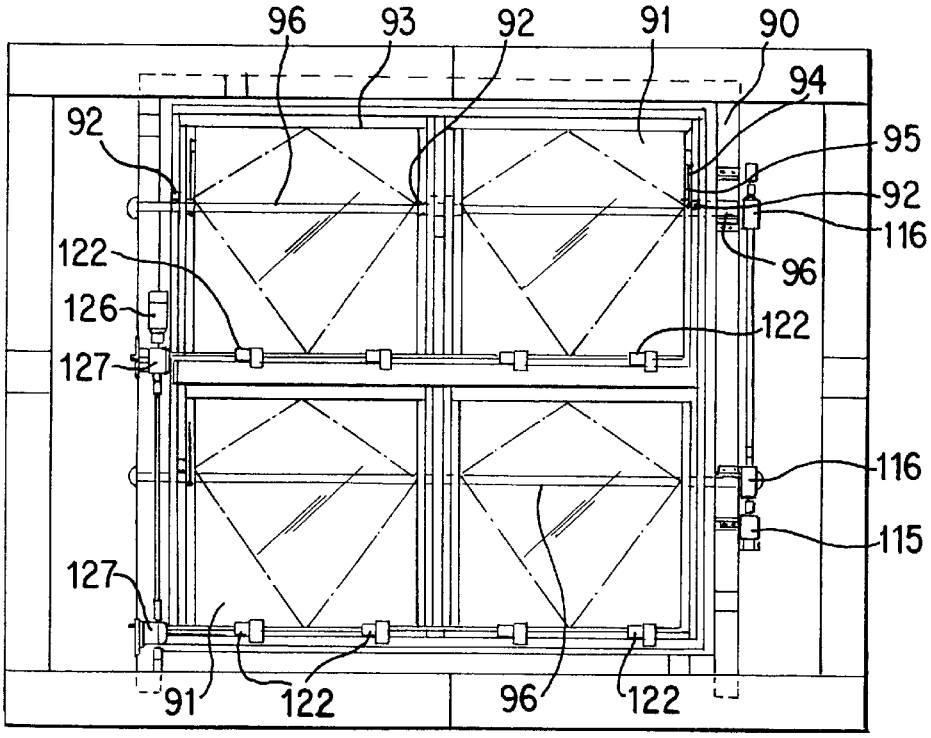
FIG. 9*a* is a front view showing a ventilating window having a mechanism for opening and closing window casements by utilizing the force of natural wind.
Figure 11:
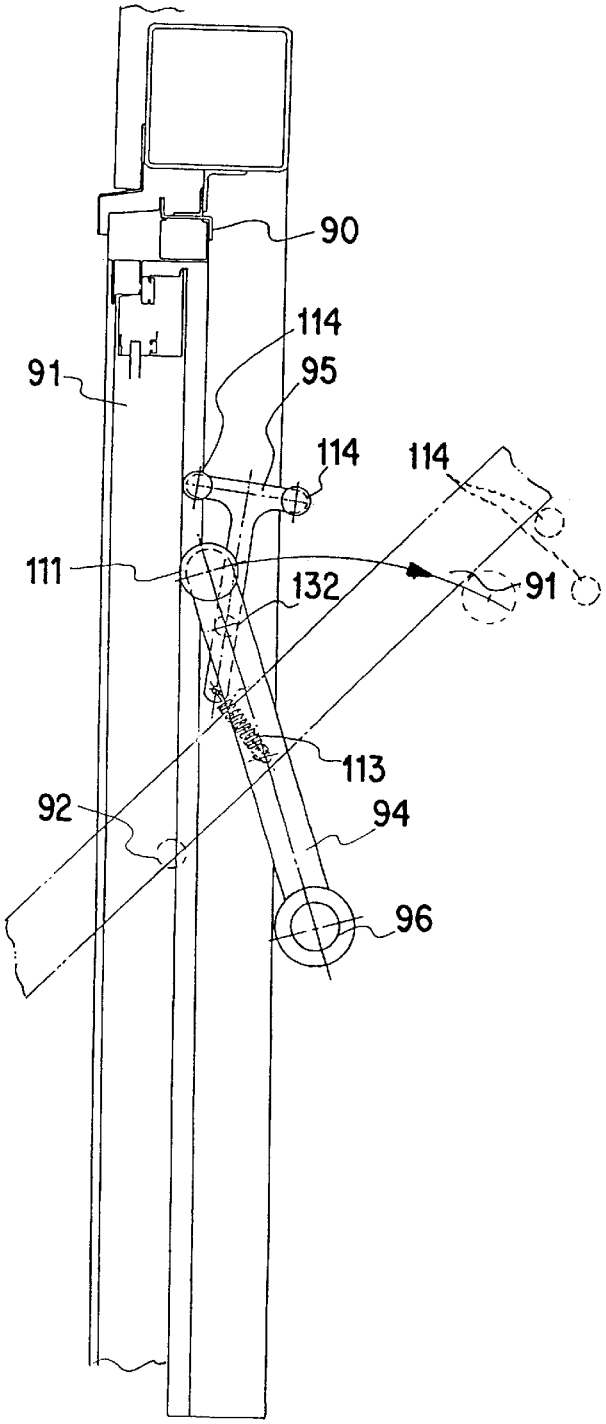
FIG. 11 is a diagram showing a construction of a stopper for the window illustrated in FIG. 9*a*.
Figure 12A:
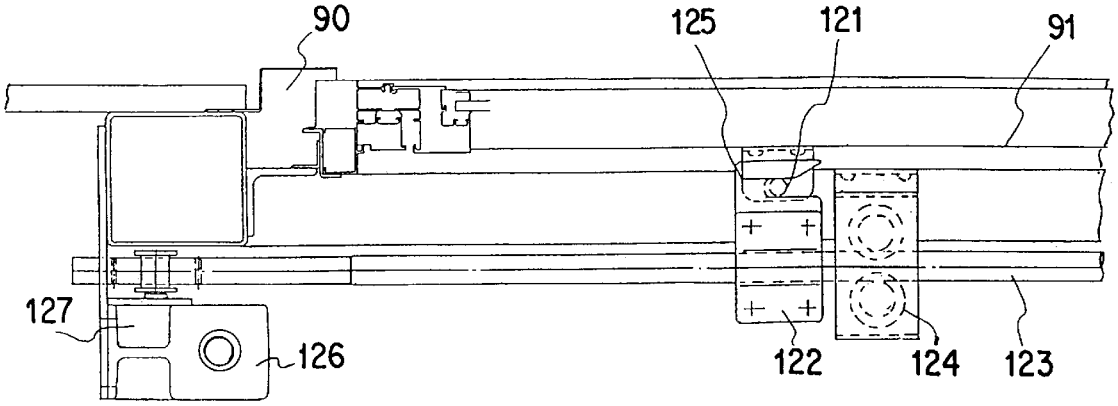
FIG. 12*a* is a plan view showing a construction for locking the window casements illustrated in FIG. 9*a*.
Figure 12B:
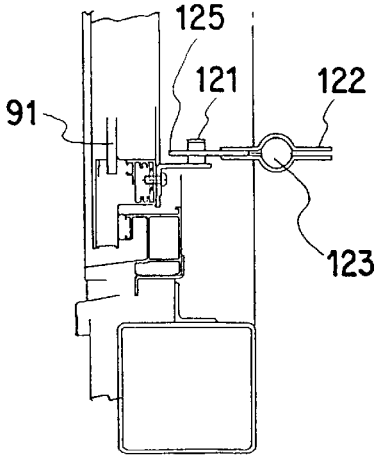
FIG. 12*b* is a sectional view thereof.

The ventilating window illustrated in these figures utilizes the force of natural wind as the power for opening and closing window casements. As shown in FIG. 9*a*, the ventilating window includes four window casements 91. Each window casement 91 is pivotably secured through a horizontal pivot shaft 92 to a window frame 90 which is mounted to a wall surface. With a restriction arm 94 which functions as a stopper and a buffer arm 95, as shown in FIG. 11, the range of rotation of the window casement 91 is restricted to the range from a substantially vertical state (closed state) up to a full open angle of 45 degrees clockwise in the figure.

Figure 10:
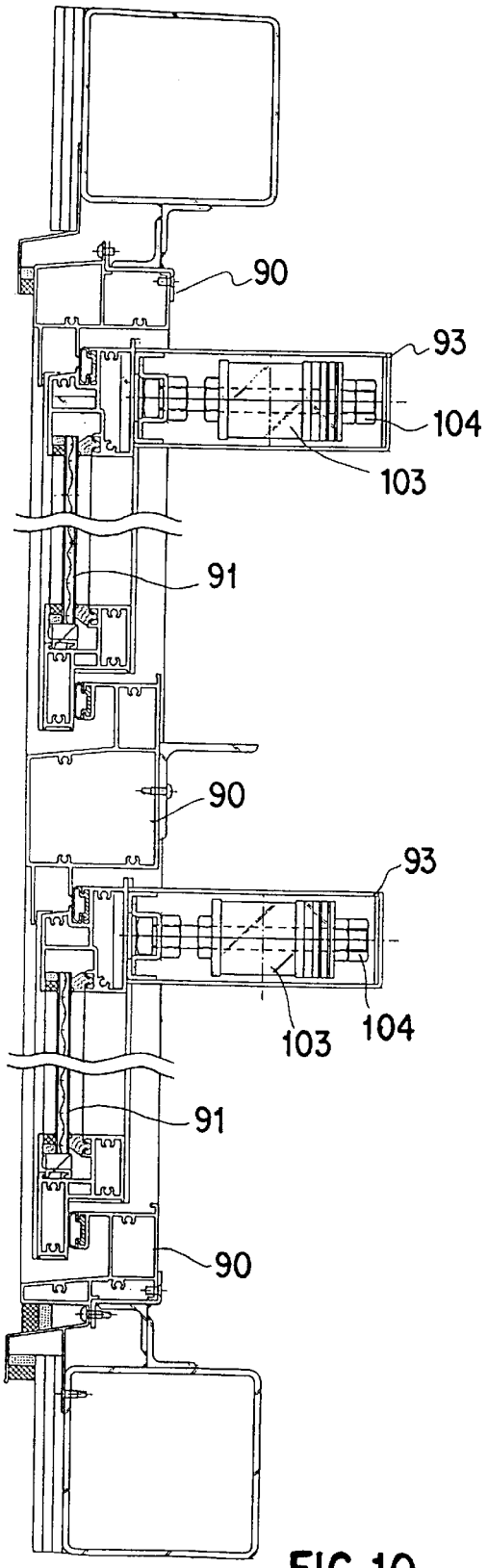
FIG. 10 is a diagram showing a detailed construction of the window casements illustrated in FIG. 9*a;*

In the vicinity of the ventilating window, there are provided a wind pressure sensor 98 for detecting the pressure of wind blown against the exterior wall surface in the area where the ventilating window is installed, and a lock controller 99 which determines whether the data detected by the wind pressure sensor has exceeded a predetermined upper-limit value or not and which, if the answer is affirmative, issues a command for locking each window casement in a closed condition. At the upper end portion of each window casement 91 is provided a protective casing 93 which protrudes to the interior side, as shown in FIG. 10. In the interior of the casing 93 is disposed a counter-balance weight 103 so as to be adjustable its position in a direction perpendicular to the window casement plane by means of a mounting nut 104.

The horizontal pivot shaft 92 of each window casement is pivotally secured to the window frame 90 in a position which is offset upward in the window casement plane. The position is selected so as to be always higher than the centroid position of the window casement including the balance weight 103. The relation of balance between a rotational moment (clockwise downward in FIG. 9*b* relative to the opening direction) of the upper portion of the window casement with respect to the pivot shaft 92 and a rotational moment (clockwise upward in FIG. 9*b* relative to the opening direction) can be adjusted by adjusting the position of the balance weight 103 with the mounting nut 104. The protective casing 93 is capable of being opened and closed, and when it is in the closed position, it protects the balance weight 103 and the mounting nut 104 for adjusting the position of the balance weight against the deposition of dust.

When wind is blown against each window casement 91 which is in an open condition and the interior atmospheric pressure becomes higher than the interior atmospheric pressure, the lower portion of the window casement with respect to the pivot shaft 92 undergoes the action of a stronger force, so that a rotational moment acting in the closing direction (counter-clockwise in FIG. 9*a*) is developed in the window casement, whereby the window casement is turned in its closing direction. Conversely, when there no longer is any difference in atmospheric pressure between the inside and outside of the window casement 91 which is in a closed condition, the window casement reverts to its open condition automatically. Further, as the interior atmospheric pressure becomes higher than the exterior atmospheric pressure, the rotational moment of the window casement advances in the reverse direction, so that the window casement 91 is turned in its opening direction.

As a stopper mechanism for restricting the full open angle of the window casement 91 relative to the window frame 90, the restriction arm 94 is fixed perpendicularly to an end portion of a horizontal operating shaft 96 disposed near the horizontal pivot shaft 92 of the window casement 91. To the front end portion of the restriction arm 94 is mounted the buffer arm 95 which is T-shaped in section. As shown in FIGS. 9*a* and 11, the operating shaft 96 is rotated by a rotating force outputted from a motor 115 which is decelerated by a gear box 116, and the restriction arm 94 performs a swing motion with the rotation of the operating shaft 96. The swing motion of the restriction arm 94 is performed in an angular range from the position where the front end of the restriction arm abuts the window casement 91 in a closed condition to the position (indicated with a dotted line) where the front end abuts the window casement which is inclined 45 degree to the interior side. The rotational angle range of the window casement depends on the swing angle range of the restriction arm 94.

A shock absorbing member 111 formed of an elastic rubber is attached to the front end of the restriction arm 94, whereby the occurrence of a shock is prevented upon abutment of the front end of the restriction arm 94 against the window casement 91.

The buffer arm 95 attached to the front end portion of the restriction arm 94 is pivotable through a fulcrum 112. The lower end portion of the buffer arm 95 below the fulcrum 112 is pulled to the restriction arm side at all times by means of a spring member 113 stretched between the buffer arm 95 and the restriction arm 94. As a result, the T-shaped top of the buffer arm 95 is urged continually toward the window casement. Also to both ends of the T-shaped top of the buffer arm 95 are attached shock absorbing members 114 formed of an elastic rubber. Before the front end of the restriction arm 94 abuts the window casement 91, the both ends of the buffer arm 95 come into abutment with the window casement to buffer the resulting shock by the action of both rubber and spring. The arms 94 and 95 function as a stopper mechanism in the opening and closing motions of the window casement.

A full open angle of the window casement 91 relative to the window frame 90 is restricted by both restriction arm 94 and buffer arm 95. A study will now be made about the case where the stopper mechanism of such a construction is applied to the ventilating windows mounted in the building shown in FIG. 1 or FIGS. 2*a* and 2*b*. In each of the ventilating windows positioned windward, if the shock absorbing member 111 at the front end of the restriction arm 94 and the shock absorbing members 114 at both ends of the T-shaped top of the buffer arm 95 are abutted against the upper portion of the window casement with respect to the horizontal pivot shaft, it is possible to hold the window casement in its closed condition while restricting its opening motion. Conversely, in each of the ventilating windows positioned leeward, if the restriction arm 94 is turned and the shock absorbing members 114 at both ends of the T-shaped top of the buffer arm 95 are brought into abutment with the upper portion of the window casement which is in a 45° tilted condition, then the window casement naturally assumes its open condition, but it is possible to prevent its open (pivoting) angle from exceeding 45°. Besides, since the shock absorbing member 111 and the shock absorbing members 114 affixed to both ends of the T-shaped top of the buffer arm 95 absorb the resulting shock, it is possible to prevent the occurrence of trouble and wobbling sound in various portions.

In the case where the stopper mechanism in question is applied to each of the upper ventilating windows mounted in the building shown in FIG. 3, the window casement naturally goes into its closed condition due to a difference in atmospheric pressure when the interior atmospheric pressure is lower than the exterior atmospheric pressure, even with the restriction arm 94 itself being in the open position (45° position). When the interior atmospheric pressure is higher than the exterior atmospheric pressure, the window casement is opened under the influence of such a difference in atmospheric pressure. Even when the difference in atmospheric pressure is large, the shock absorbing member 111 at the front end of the restriction arm 94 and the shock absorbing members 114 at both ends of the T-shaped top of the buffer arm 95 come into abutment with the window casement to restrict the pivotal movement of the window casement up to the tilting position of 45°.

Figure 9B:
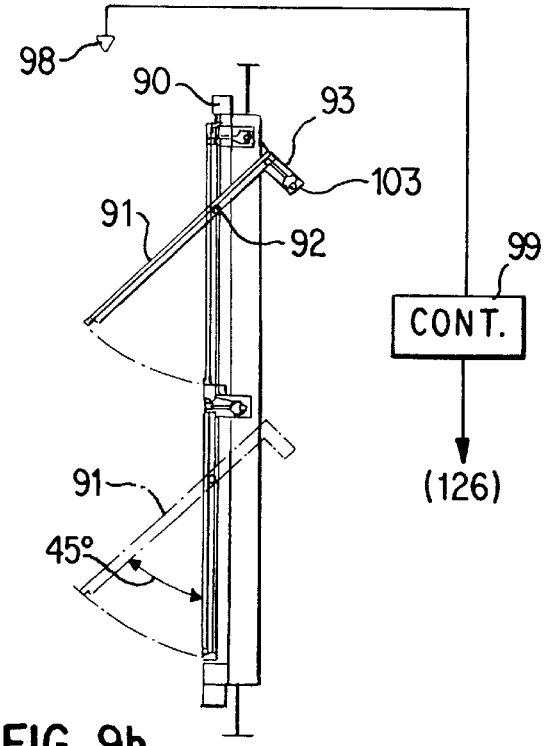
FIG. 9*b* illustrates opening and closing motions of the window casements.

In the ventilating window shown in FIGS. 9*a* and 9*b*, a lock mechanism for holding the window casement 91 selectively in the closed condition is provided at the lower portion of the window casement. This lock mechanism comprises a lock pin 121 provided at the lower end portion of the window casement 91, a slide shaft 123, and a locking piece 122 disposed on the slide shaft 123 for locking the lock pin 121. On the exterior side is disposed a wind pressure sensor 98 for detecting the pressure of wind blowing against the window casement 91 and the vicinity thereof. Data detected by the sensor 98 is fed to the lock controller 99, in which it is compared with a predetermined upper-limit value. When the detected wind pressure is larger than the upper-limit value, the lock controller 99 drives a motor 126. Rotational output from the motor 126 is decelerated by a gear box 127 and then transmitted to the slide shaft 123, so that the slide shaft 123 moves along the guide frame 90 while being guided by guide rollers 124. With this movement of the slide shaft, a hook-like locking portion 125 of the locking piece 122 hooks the lock pin 121, whereby the window casement 91 is locked to the closed condition.

The wind pressure sensor used in the above embodiment is a mere example and may be substituted by, for example, sensor means which detects any one or more weather conditions from among wind direction, wind pressure, air temperature, humidity, weather, in the exterior of a building, and a difference in atmospheric pressure between the inside and outside of the building, or an intelligent sensor which determines about operating conditions of the lock mechanism from a combination of plural such weather conditions.

What is claimed is:

1. A ventilating window having an inside facing an interior of a structure to be ventilated and an outside facing an exterior of the structure to be ventilated, the window comprising:

a window frame which defines a through opening in a wall of the structure to be ventilated;

window casement means movable between a first position in which said through opening is opened and a second position in which said through opening is closed;

an automatic opening mechanism which moves said window casement means toward said first position to open said through opening when the window casement means is in said second position and when the atmospheric pressure on the inside of said window is higher than the atmospheric pressure on the outside of the window;

sensor means for detecting a difference between the atmospheric pressure on the inside of said window and the atmospheric pressure on the outside of the window;

control means which issues a command for opening said through opening when the atmospheric pressure on the inside of the window is found to be higher than the atmospheric pressure on the outside of the window by said sensor means; and drive means for moving said window casement means toward said first position in accordance with the command issued from said control means.

2. A ventilating window having an inside facing an interior of a structure to be ventilated and an outside facing an exterior of the structure to be ventilated, the window comprising:

a window frame which defines a through opening in a wall of the structure to be ventilated;

window casement means movable between a first position in which said through opening is opened and a second position in which said through opening is closed;

an automatic opening mechanism which moves said window casement means toward said first position to open said through opening when the window casement means is in said second position and when the atmospheric pressure on the inside of said window is higher than the atmospheric pressure on the outside of the window;

wind sensor means for detecting the direction of wind blowing against said structure;

control means which issues a command for opening said through opening when the window is found to be located leeward by said wind sensor means; and drive means for moving said window casement means lying in said second position toward said first position in accordance with the command issued from said control means.

3. A ventilating window having an inside facing an interior of a structure to be ventilated and an outside facing an exterior of the structure to be ventilated, the window comprising:

a window frame which defines a through opening in a wall of the structure to be ventilated;

window casement means movable between a first position in which said through opening is opened and a second position in which said through opening is closed; and an automatic opening mechanism which moves said window casement means toward said first position to open said through opening when the window casement means is in said second position and when the atmospheric pressure on the inside of said window is higher than the atmospheric pressure on the outside of the window;

wherein said window casement means has a substantially flat surface and is mounted to said window frame pivotably through a horizontal pivot shaft, said horizontal pivot shaft being located in a position to divide said window casement means into upper and lower portions of unequal areas, and wherein said window casement means is provided with counter balance means for substantially balancing static loads of said upper and lower portions.

4. A ventilating window having an inside facing an interior of a structure to be ventilated and an outside facing an exterior of the structure to be ventilated, the window comprising: p1 a window frame which defines a through opening in a wall of the structure to be ventilated;

window casement means movable between a first position in which said through opening is opened and a second position in which said through opening is closed;

an automatic closing mechanism which moves said window casement means toward said second position to close said through opening when the window casement means is in said first position and when the atmospheric pressure on the outside of said window is higher than the atmospheric pressure on the inside of the window;

sensor means for detecting a difference between the atmospheric pressure on the inside of said window and the atmospheric pressure on the outside of the window;

control means which issues a command for closing said through opening when the atmospheric pressure on the outside of the window is found to be higher than the atmospheric pressure on the inside of the window by said sensor means; and drive means for moving said window casement means lying in said first position toward said second position in accordance with the command issued from said control means.

5. A ventilating window having an inside facing an interior of a structure to be ventilated and an outside facing an exterior of the structure to be ventilated, the window comprising:

a window frame which defines a through opening in a wall of the structure to be ventilated;

window casement means movable between a first position in which said through opening is opened and a second position in which said through opening is closed;

an automatic closing mechanism which moves said window casement means toward said second position to close said through opening when the window casement means is in said first position and when the atmospheric pressure on the outside of said window is higher than the atmospheric pressure on the inside of the window;

wind sensor means for detecting the direction of wind blowing against said structure;

control means which issues a command for closing said through opening when the window is found to be windward by said wind sensor means; and drive means for moving said window casement means lying in said first position toward said second position in accordance with the command issued from said control means.

6. A ventilating window having an inside facing an interior of a structure to be ventilated and an outside facing an exterior of the structure to be ventilated, the window comprising:

a window frame which defines a through opening in a wall of the structure to be ventilated;

window casement means movable between a first position in which said through opening is opened and a second position in which said through opening is closed; and an automatic closing mechanism which moves said window casement means toward said second position to close said through opening when the window casement means is in said first position and when the atmospheric pressure on the outside of said window is higher than the atmospheric pressure on the inside of the window;

wherein said window casement means has a substantially flat surface and is mounted to said window frame pivotably through a horizontal pivot shaft, said horizontal pivot shaft being located in a position to divide said window casement means into upper and lower portions of unequal areas, and wherein said window casement means is provided with counter balance means for substantially balancing static loads of said upper and lower portions.

7. A ventilating mechanism for realizing a natural ventilation in the interior of a structure to be ventilated having walls, said ventilating mechanism comprising:

a first ventilating window having an inside facing an interior of the structure to be ventilated and an outside facing an exterior of the structure to be ventilated, the first ventilating window including first window casement means movable between a first opening position and a first closing position, and an automatic opening mechanism which moves said first window casement means toward said first opening position when the first window casement means is in said first closing position and when the atmospheric pressure on the inside of said first ventilating window is higher than the atmospheric pressure on the outside of the first ventilating window, and a second ventilating window having an inside facing an interior of the structure to be ventilated and an outside facing an exterior of the structure to be ventilated, the first ventilating window including second window casement means movable between a second opening position and a second closing position, and an automatic closing mechanism which moves said second window casement means toward said second closing position when the second window casement means is in said second opening position and when the atmospheric pressure on the outside of said second ventilating window is higher than the atmospheric pressure on the inside of the second ventilating window.

8. A ventilating mechanism according to claim 7, wherein:

said first ventilating window is mounted in a first wall of said structure to be ventilated; and said second ventilating window is mounted in a second wall of said structure to be ventilated, said second wall being opposed to said first wall.

9. A ventilating mechanism according to claim 7, wherein:

said first ventilating window is mounted in an upper position of a wall of said structure to be ventilated; and said second ventilating window is mounted in a lower position of said wall.

10. A combination according to claim 1, wherein:

said first ventilating window is mounted in an upper position of a first wall of said structure to be ventilated; and said second ventilating window is mounted in a lower position of a second wall of said structure to be ventilated.

11. A ventilating window having an inside facing an interior of a structure to be ventilated and an outside facing an exterior of the structure to be ventilated, the window comprising:

a window frame which defines a through opening in a wall of the structure to be ventilated;

window casement means movable between a first position in which said through opening is opened and a second position in which said through opening is closed;

an automatic opening mechanism which moves said window casement means toward said first position to open said through opening when the window casement means is in said second position and when the atmospheric pressure on the inside of said window is higher than the atmospheric pressure on the outside of the window;

an automatic closing mechanism which moves said window casement means toward said second position to close said through opening when the window casement means is in said first position and when the atmospheric pressure on the outside of said window is higher than the atmospheric pressure on the inside of the window;

sensor means for detecting a difference, between the atmospheric pressure on the inside of said window and the atmospheric pressure on the outside of the window;

control means which issues a first command for opening said through opening when the atmospheric pressure on the inside of the window is found to be higher than the atmospheric pressure on the outside of the window by said sensor means, and which issues a second command for closing said through opening when the atmospheric pressure on the outside of the window is higher than the atmospheric pressure on the inside of the window; and drive means for moving said window casement means toward said first position upon issuance of said first command from said control means and for moving said window casement means toward said second position upon issuance of said second command from said control means.

12. A ventilating window according to claim 11, further comprising:

lock control means for fixing said window casement means forcibly to said second position when the difference in atmospheric pressure detected by said sensor means exceeds a predetermined threshold value.

13. A ventilating window having an inside facing an interior of a structure to be ventilated and an outside facing an exterior of the structure to be ventilated, the window comprising:

a window frame which defines a through opening in a wall of the structure to be ventilated;

window casement means movable between a first position in which said through opening is opened and a second position in which said through opening is closed;

an automatic opening mechanism which moves said window casement means toward said first position to open said through opening when the window casement means is in said second position and when the atmospheric pressure on the inside of said window is higher than the atmospheric pressure on the outside of the window;

an automatic closing mechanism which moves said window casement means toward said second position to close said through opening when the window casement means is in said first position and when the atmospheric pressure on the outside of said window is higher than the atmospheric pressure on the inside of the window;

wind sensor means for detecting the direction and force of wind blowing against said structure;

control means which issues a first command for opening said through opening when the window is found to lie leeward by said wind sensor means and which issues a second command for closing said through opening when the window is found to lie windward by said wind sensor means; and drive means for moving said window casement means lying in said second position toward said first position upon issuance of said first command from said control means and for moving the window casement means lying in said first position toward said second position upon issuance of said second command from the control means.

14. A ventilating window according to claim 13, further comprising:

lock control means for fixing said window casement means forcibly to said second position when the force of wind detected by said wind sensor means exceeds a predetermined threshold value.

15. A ventilating window having an inside facing an interior of a structure to be ventilated and an outside facing an exterior of the structure to be ventilated, the window comprising:

a window frame which defines a through opening in a wall of the structure to be ventilated;

window casement means movable between a first position in which said through opening is opened and a second position in which said through opening is closed;

an automatic opening mechanism which moves said window casement means toward said first position to open said through opening when the window casement means is in said second position and when the atmospheric pressure on the inside of said window is higher than the atmospheric pressure on the outside of the window; and an automatic closing mechanism which moves said window casement means toward said second position to close said through opening when the window casement means is in said first position and when the atmospheric pressure on the outside of said window is higher than the atmospheric pressure on the inside of the window;

wherein said window casement means has a substantially flat surface and is mounted to said window frame pivotably through a horizontal pivot shaft, said horizontal pivot shaft being located in a position to divide said window casement means into upper and lower portions of unequal areas, and wherein said window casement means is provided with counter balance means for substantially balancing static loads of said upper and lower portions.

16. A ventilating window according to claim 15, further comprising:

stopper means for restricting the angle of rotation of said window casement means about said horizontal pivot shaft to an angle of rotation falling under a predetermined angular range.

17. A ventilating window according to claim 15, further comprising:

sensor means for detecting one or more weather conditions from among wind direction, wind pressure, air temperature, humidity, weather, in the exterior of said structure, and a difference in atmospheric pressure between the inside and outside of the structure; and automatic lock means for fixing said window casement means forcibly to said second position when the result of detection by said sensor means exceeds a predetermined threshold value.

* * * * *